US011085215B1

(12) United States Patent
VanVolkinburg

(10) Patent No.: US 11,085,215 B1
(45) Date of Patent: Aug. 10, 2021

(54) HINGE PIN AND ASSOCIATED DOOR HINGE ASSEMBLY

(71) Applicant: Clayton Dean VanVolkinburg, Dorr, MI (US)

(72) Inventor: Clayton Dean VanVolkinburg, Dorr, MI (US)

( * ) Notice: Subject to any disclaimer, the term of this patent is extended or adjusted under 35 U.S.C. 154(b) by 0 days.

(21) Appl. No.: 17/004,132

(22) Filed: Aug. 27, 2020

(51) Int. Cl.
*E05D 11/02* (2006.01)
*E05D 3/02* (2006.01)
*E05D 5/10* (2006.01)

(52) U.S. Cl.
CPC ..... *E05D 11/02* (2013.01); *E05D 3/02* (2013.01); *E05D 5/10* (2013.01); *E05D 2005/104* (2013.01); *E05D 2005/106* (2013.01)

(58) Field of Classification Search
CPC .. E05D 11/02; E05D 3/02; E05D 5/10; E05D 2005/104; E05D 2005/106
USPC ..... 16/386, 274
See application file for complete search history.

(56) References Cited

U.S. PATENT DOCUMENTS 1,030,801 A * 6/1912 Berault ..... E05D 7/1016 16/262
1,433,095 A * 10/1922 Peary ..... E05D 11/02 16/274
1,673,459 A * 6/1928 Jurad ..... B60R 17/00 384/396
1,677,441 A * 7/1928 Gonyk ..... E05D 11/02 16/274
1,898,936 A * 2/1933 Brawley ..... E05D 11/02 16/274
2,053,864 A * 9/1936 Cook ..... E05D 11/02 16/274
2,570,942 A * 10/1951 Hadfield ..... F16N 7/00 16/274
3,407,903 A * 10/1968 Sansabrino ..... F16B 33/00 184/14
3,621,512 A * 11/1971 Johnson ..... E05D 5/128 16/380
4,679,285 A * 7/1987 Ballantyne ..... B21D 53/40 16/274
5,755,011 A 5/1998 Green et al.
5,765,263 A 6/1998 Bolinas et al.
5,771,538 A * 6/1998 Huppert, Sr. ..... E05D 11/02 16/274
D401,134 S 11/1998 Finkelstein
6,317,928 B1 11/2001 Guillemette
6,514,002 B1 * 2/2003 Katae ..... F16C 11/02 403/150
6,742,932 B2 * 6/2004 Eisenberg ..... F16C 33/6622 184/5.1
D551,940 S 10/2007 Whinery
7,406,749 B2 8/2008 Herper
(Continued)

*Primary Examiner* — Jeffrey O'Brien
(74) *Attorney, Agent, or Firm* — King & Partners, PLC

(57) ABSTRACT

A hinge pin that allows for clean and convenient internal lubrication of associated door hinge assemblies, including: a head, a body, and a tip; wherein the head includes a fluid reservoir, and a fluid input aperture; wherein the body includes a first end, a second end, wherein the first end and the second end define a length therebetween, at least one fluid output aperture, a primary bore, and a secondary bore; and wherein the primary and secondary bores are positioned between the fluid input aperture and the at least one fluid output aperture, and define a pathway for fluid flow therebetween.

14 Claims, 13 Drawing Sheets

(56) References Cited

U.S. PATENT DOCUMENTS

| | | | | |
|---|---|---|---|---|
| 7,603,746 | B1 * | 10/2009 | von Resch | E05D 7/0054 16/238 |
| D607,709 | S | 1/2010 | Mizon | |
| 7,676,887 | B2 | 3/2010 | Chung | |
| D658,031 | S | 4/2012 | Mitchell et al. | |
| 8,156,611 | B2 | 4/2012 | Machin et al. | |
| 8,191,205 | B2 | 6/2012 | Forrest | |
| 8,307,513 | B1 | 11/2012 | Fitzgerald | |
| 8,359,709 | B2 | 1/2013 | Van Gennep | |
| 8,561,261 | B2 * | 10/2013 | Gibson | E05D 11/04 16/274 |
| 8,701,247 | B1 * | 4/2014 | Shargh | E05D 11/02 16/274 |
| 8,739,366 | B2 | 6/2014 | Heninger | |
| D710,181 | S | 8/2014 | Christensen et al. | |
| D726,525 | S | 4/2015 | Kenerly et al. | |
| 9,068,382 | B1 | 6/2015 | Hall | |
| D790,317 | S | 6/2017 | Christensen et al. | |
| D808,244 | S | 1/2018 | Fraijo | |
| D816,460 | S | 1/2018 | Branning | |
| 10,612,284 | B1 * | 4/2020 | Johnson | E05D 3/02 |
| 2011/0061196 | A1 * | 3/2011 | Cox | E05D 11/02 16/274 |
| 2012/0079683 | A1 * | 4/2012 | Spragg | E05D 11/02 16/274 |
| 2013/0104341 | A1 * | 5/2013 | Kenerly | E05D 3/02 16/273 |
| 2015/0285435 | A1 * | 10/2015 | Alghamdi | E05D 11/02 16/386 |
| 2019/0003226 | A1 * | 1/2019 | Alghamdi | F16N 7/02 |
| 2019/0292821 | A1 * | 9/2019 | Gunner | E05D 5/12 |
| 2020/0284080 | A1 * | 9/2020 | Conner, II | E05D 11/02 |

* cited by examiner

HINGE PIN AND ASSOCIATED DOOR HINGE ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The present invention relates in general to hinge pins and, more particularly, to hinge pins that allow for clean and convenient internal lubrication of associated door hinge assemblies. The door hinge assemblies of the present invention are preferably associated with, for example, residential, commercial, and industrial interior and/or exterior doors.

2. Background Art

Hinge pins and associated door hinge assemblies have been known in the art for years and are the subject of a plurality of patents and publications, including: U.S. Pat. No. 9,068,382 entitled "Locking Hinge Assembly," U.S. Pat. No. 8,739,366 entitled "Hinge-Integrated Adjustable Door Stop," U.S. Pat. No. 8,307,513 entitled "Door Hinge with Integrated Preset Stops," U.S. Pat. No. 8,191,205 entitled "Door Hinge," U.S. Pat. No. 7,676,887 entitled "Two-Stage Adjustable Door Hinge," U.S. Pat. No. 7,406,749 entitled "Multi-Link Hinge," U.S. Pat. No. 5,755,011 entitled "Adjustable Hinge," U.S. Pat. No. 3,621,512 entitled "Tamper Resistant Hinge," U.S. Pat. No. 1,030,801 entitled "Hinge," and United States Patent Application Publication Number 2013/0104341 entitled "Door Hinge Assembly"—all of which are hereby incorporated herein by reference in their entirety including all references cited therein.

U.S. Pat. No. 9,068,382 appears to disclose a locking hinge assembly having a first hinge plate and a sleeve bushing defining a through passageway and a tooth channel with opposing side walls; a second hinge plate and a sleeve bushing, for co-axial alignment of the sleeve bushings; and a splined pin received in the aligned sleeve bushings, the splined pin having a root diameter and at least one tooth projecting therefrom for being received selectively in the tooth channel, whereby the tooth being received in the tooth channel permits rotational movement of the sleeve barrel relative to the barrel until the pin is stopped by one of the side walls of the tooth channel.

U.S. Pat. No. 8,739,366 appears to disclose a hinge that has a hinge-integrated stop. The hinge includes a first hinge leaf having a substantially-planar portion with a pivot edge and a top edge. The first hinge leaf includes a first knuckle extending from the pivot edge of the substantially-planar portion near the top edge. The first knuckle of the first leaf includes an inner splined surface. The hinge also includes a second hinge leaf having a substantially-planar portion having a pivot edge. A first knuckle extends from the pivot edge of the substantially-planar portion of the second hinge leaf, where the first knuckle has an inner surface and a first knuckle stop element on the inner surface. A hinge pin has a shaft having a shaft diameter and an upper splined portion having fingers extending beyond the shaft diameter and a hinge pin stop element located on the shaft below the upper splined portion.

U.S. Pat. No. 8,307,513 appears to disclose a hinge for a swinging door. The hinge includes first and second leaves, each having knuckles, and a pin which rotatably attaches the first and second leaves together. The first knuckle of the first leaf includes a detent, the first knuckle of the second leaf includes first, second, and optionally third, channels, and the pin includes first and second ribs. The first rib is positioned within a desired channel thereby fixing the relative position between the pin and second leaf and predetermining the swing range of the door, which is restricted when the detent engages the first rib. The second rib acts as a spacer to keep the pin from moving away from and over the detent when the door has reached its predetermined swing range. In this fashion, the hinge limits the swing range of a door to keep the door from striking an adjacent wall.

U.S. Pat. No. 8,191,205 appears to disclose a hinge pin extending along an axis and a first knuckle for receiving the hinge pin. The first knuckle is rotatable about the axis. A second knuckle for receiving the hinge pin and is rotatable about the axis. At least one bearing limits relative rotation between the first hinge knuckle and the hinge pin. The hinge assembly may include a tolerance ring between the hinge pin and the first knuckle to urge the bearing away from the axis. A method of producing a hinge includes the steps of permitting a first hinge plate to move relative a hinge pin and limiting movement of a second hinge plate relative a hinge pin. The method biases a bearing adjacent the hinge pin to limit movement of the second hinge plate relative the hinge pin.

U.S. Pat. No. 7,676,887 appears to disclose a door hinge adapted to provide vertical and depth adjustments of an engaged door with a door frame. The hinge features a first hinge member adapted for fixed recessed engagement to a side edge of a door jamb which is rotationally engaged with a support member extending from a second hinge member adapted for engagement to the door. Adjustment of height and depth of the door inside the door jamb is easily achieved by rotation of adjustment screws accessible from a single surface that is visible when the second hinge member is engaged to the door.

U.S. Pat. No. 7,406,749 appears to disclose a multi-link hinge for hinging a door leaf to the body of a piece of furniture with a body fitting which may be fixed to the support wall of the body and a door leaf fitting connected to the above by means of a joint mechanism. The support wall fitting, embodied as an extended support arm is arranged on a fitting plate which may be fixed to the support wall of the body and coupled to the door leaf fitting, embodied as a hinge cup fitted in a recess in the back face of the door leaf, by means of the joint mechanism, embodied with two joint arms each connected to one of the fittings such as to pivot. A damping device acts on a support wall side hinge piece, for example the body fitting or the fixing plate and one of the joint arms, at least during a locking part of the pivoting motion of said joint arm on a closing or opening motion of the door leaf fitting.

U.S. Pat. No. 5,755,011 appears to disclose an adjustable hinge including a first hinge member having a hinge sleeve and a second hinge member having a guide, with a door leaf coupled to the second hinge member and having at least one tab received within the guide for guiding movement therealong, the door leaf is also coupled to the first hinge member and received within the hinge sleeve, allowing selective pivotal movement of the first hinge member relative to the second hinge member about a rotational axis extending in a vertical direction. The adjustable hinge features a vertical adjustment mechanism received within the hinge sleeve allowing selective movement of the first hinge member relative to the second hinge member in the vertical direction, and a horizontal adjustment mechanism within a cavity formed within the second hinge member with at least one tab of the door leaf is guidably moved along the guide, allowing selective movement of the first hinge member relative to the second hinge member in a horizontal direction.

U.S. Pat. No. 3,621,512 appears to disclose a butt hinge which a pivot pin extends through interleaved knuckle members with the end of the pivot pin the outer knuckle members forming a continuous smooth surface and with the pivot pin being retained in position by a lock pin and a plurality of swaged lungs positioned on the inward side of the knuckle members to be inaccessible when the closure member supported by the hinge is in a closed position.

U.S. Pat. No. 1,030,801 appears to disclose a loose pin butt or hinge which may be used in either a right or left position and in which the pin, while loose and removable in some positions of the leaves of the hinge, will be held securely in all other positions of the leaves.

United States Patent Application Publication Number 2013/0104341 appears to disclose a door hinge assembly. The door hinge assembly includes a first hinge plate, a second hinge plate, one or more bushings, a hinge pin and a hollow sleeve. The first and second hinge plate includes a one or more first and second knuckles aligned axially. At least one of the one or more bushings is positioned in between the first and second knuckle to prevent direct contact of first and second knuckle. The hinge pin is disposed through the first and second knuckles and one or more bushings. The hollow sleeve acts a covering to the hinge pin. The hollow sleeve further prevents contact of the sides of the first knuckle, bushings and second knuckle with the hinge pin. This prevents a direct metal on metal contact and further prevents squeak or other noises occurred during the opening and closing of the door.

While the above-identified patents and publications do appear to disclose various hinge pins and associated door hinge assemblies, their configurations remain non-desirous and/or problematic inasmuch as, among other things, none of the above-identified hinge pins appear to facilitate clean and convenient internal lubrication of associated door hinge assemblies.

These and other objects of the present invention will become apparent in light of the present specification, claims, and drawings.

SUMMARY OF THE INVENTION

The present invention is directed to a hinge pin that allows for clean and convenient internal lubrication of associated door hinge assemblies, comprising, consisting essentially of and/or consisting of: (a) a head, a body, and a tip; (b) wherein the head includes a fluid reservoir, and a fluid input aperture; (c) wherein the body includes a first end, a second end, wherein the first end and the second end define a length therebetween, at least one fluid output aperture, a primary bore, and a secondary bore; and (d) wherein the primary and secondary bores are positioned between the fluid input aperture and the at least one fluid output aperture, and define a pathway for fluid flow therebetween.

In a preferred embodiment of the present invention, the head includes a generally annular sidewall.

In another preferred embodiment of the present invention, the body includes a generally annular sidewall.

In yet another preferred embodiment of the present invention, the primary bore is positioned parallel to the length of the body.

In one preferred embodiment of the present invention, the secondary bore is positioned perpendicular to the length of the body.

In another aspect of the present invention, the hinge pin preferably further comprises a tertiary bore positioned below the primary and secondary bores.

In a preferred embodiment of the present invention, the fluid output apertures comprise two apertures that are optionally evenly spaced apart from each other.

In another preferred embodiment of the present invention, the fluid output apertures comprise four apertures.

In yet another preferred embodiment of the present invention, a portion of the body comprises a concave sidewall proximate the fluid output aperture(s).

In a preferred embodiment of the present invention, the hinge pin is fabricated from a metal, a metal alloy, a natural resin, a synthetic resin, a plastic, a composite, wood, and/or combinations thereof.

The present invention is also directed to a door hinge assembly, comprising, consisting essentially of and/or consisting of: (a) a first hinge plate, wherein the first hinge plate includes at least one knuckle; (b) a second hinge plate, wherein the second hinge plate includes at least one knuckle; and (c) a hinge pin, comprising: (1) a head, a body, and a tip; (2) wherein the head includes a fluid reservoir, and a fluid input aperture; (3) wherein the body includes a first end, a second end, wherein the first end and the second end define a length therebetween, at least one fluid output aperture, a primary bore, and a secondary bore; and (4) wherein the primary and secondary bores are positioned between the fluid input aperture and the at least one fluid output aperture, and define a pathway for fluid flow therebetween.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted.

It will be further understood that the invention is not necessarily limited to the particular embodiments illustrated herein.

Figure 1:
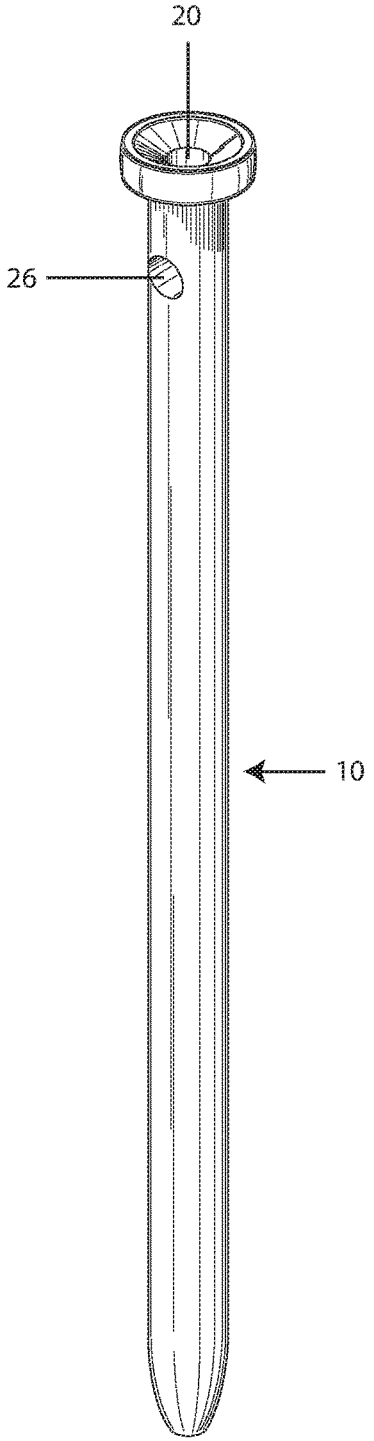
Figure 2:
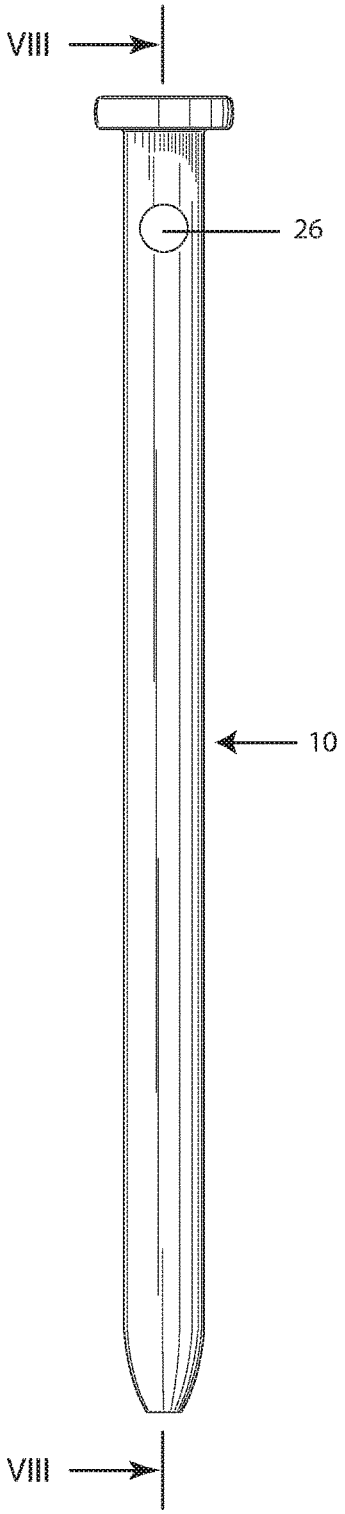
Figure 3:
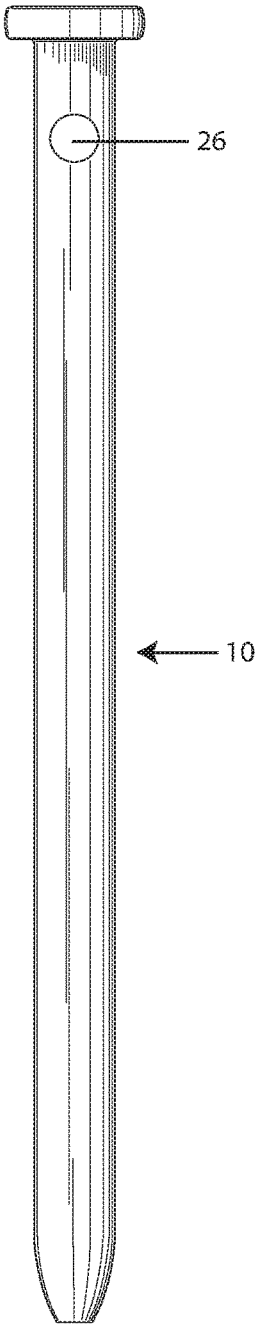
Figure 4:
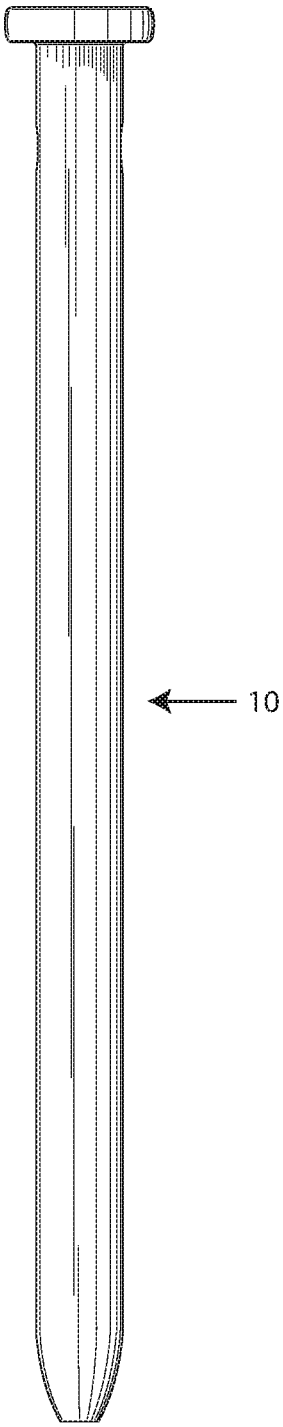
Figure 5:
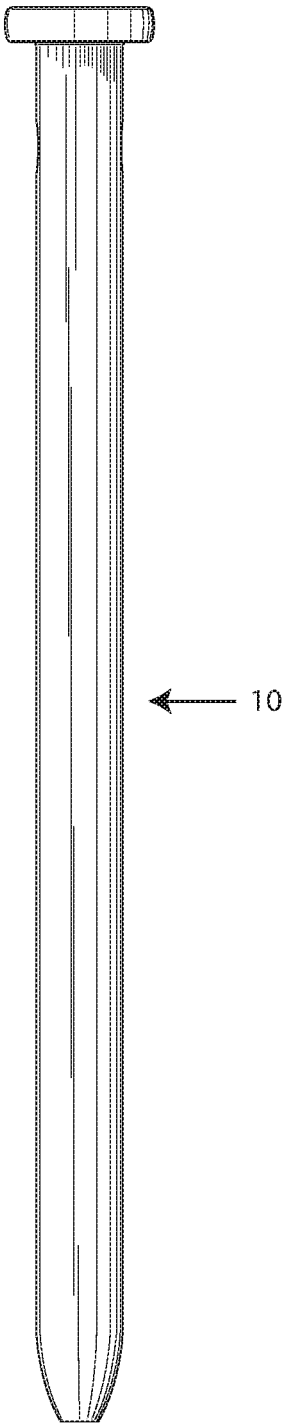
Figure 6:
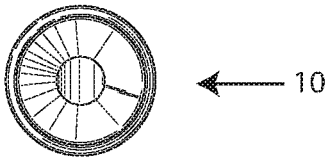
Figure 7:
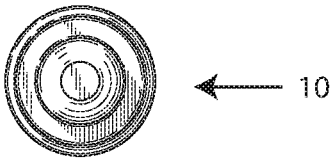
Figure 8:
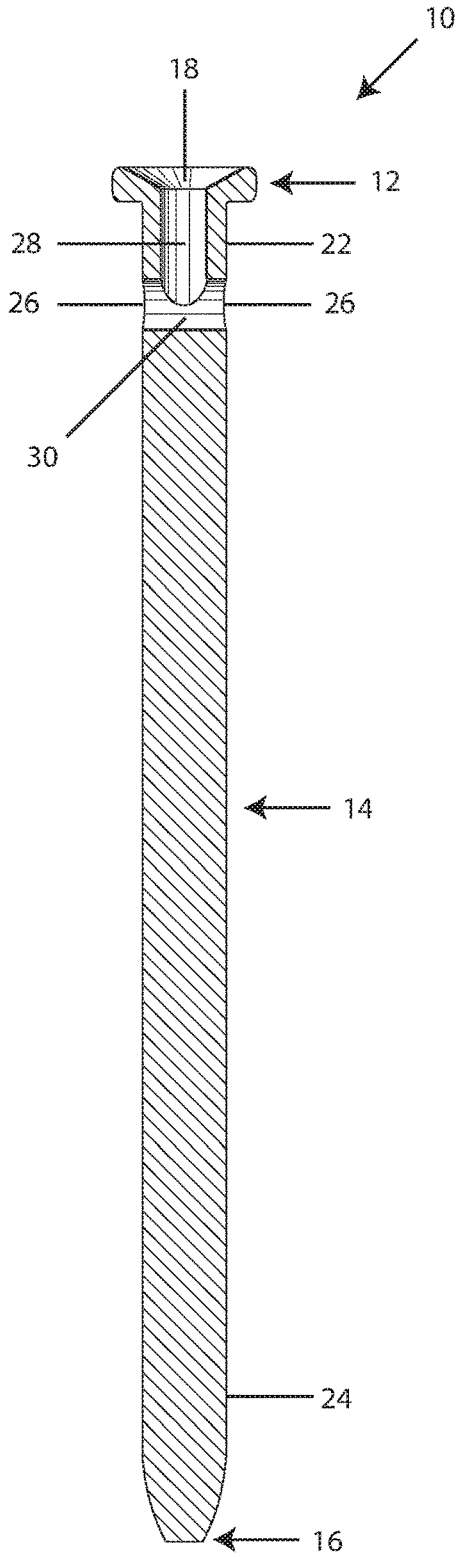
Figure 9:
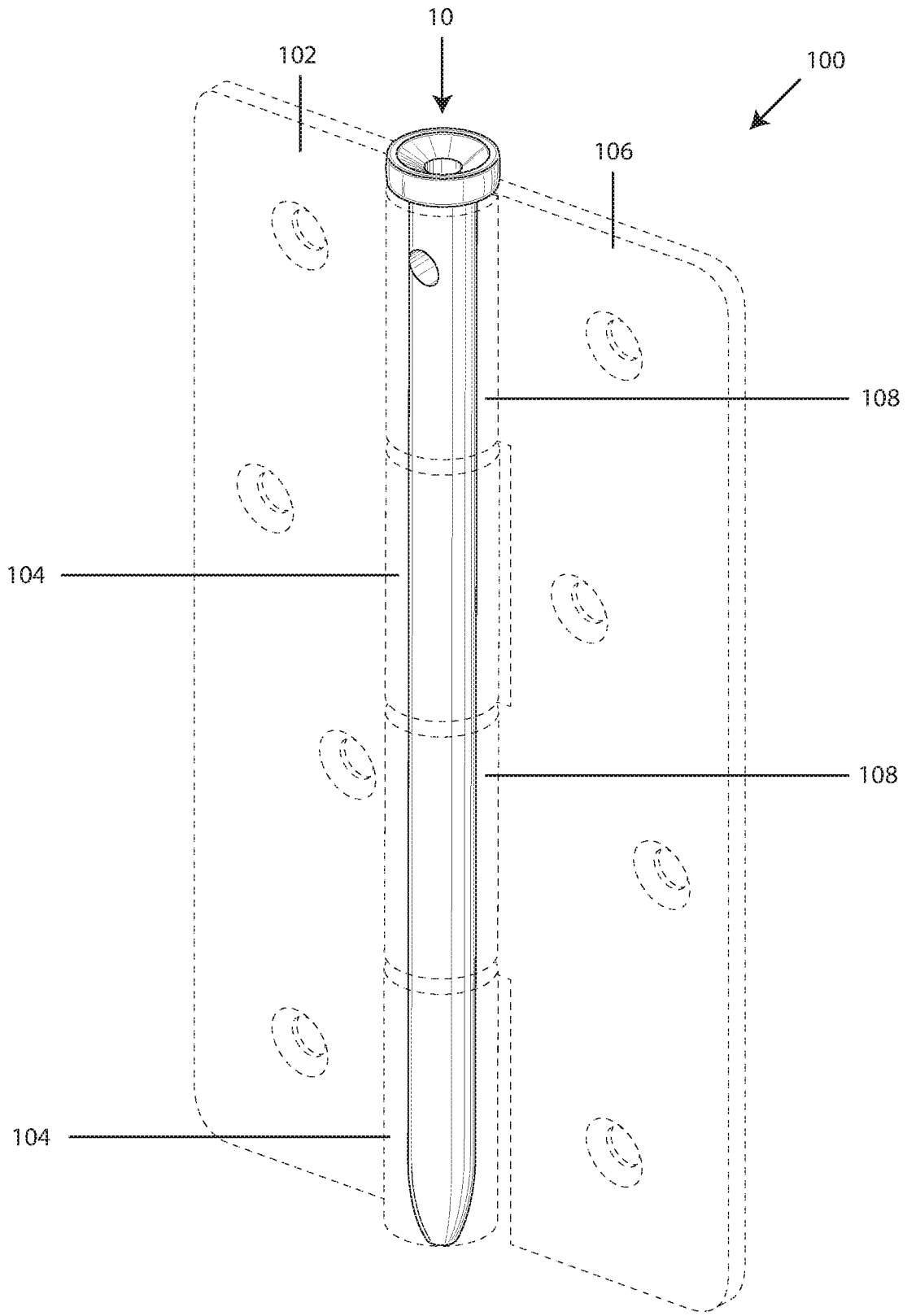
Figure 10:
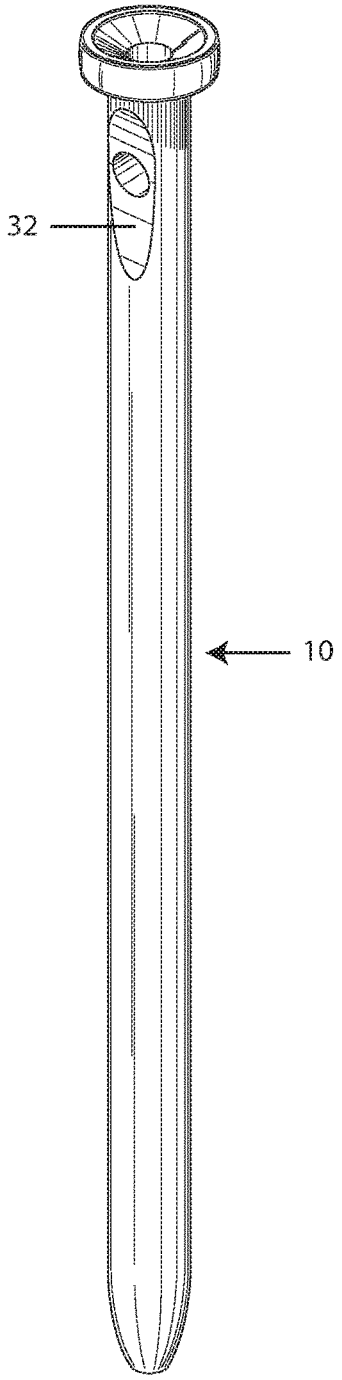
Figure 11:
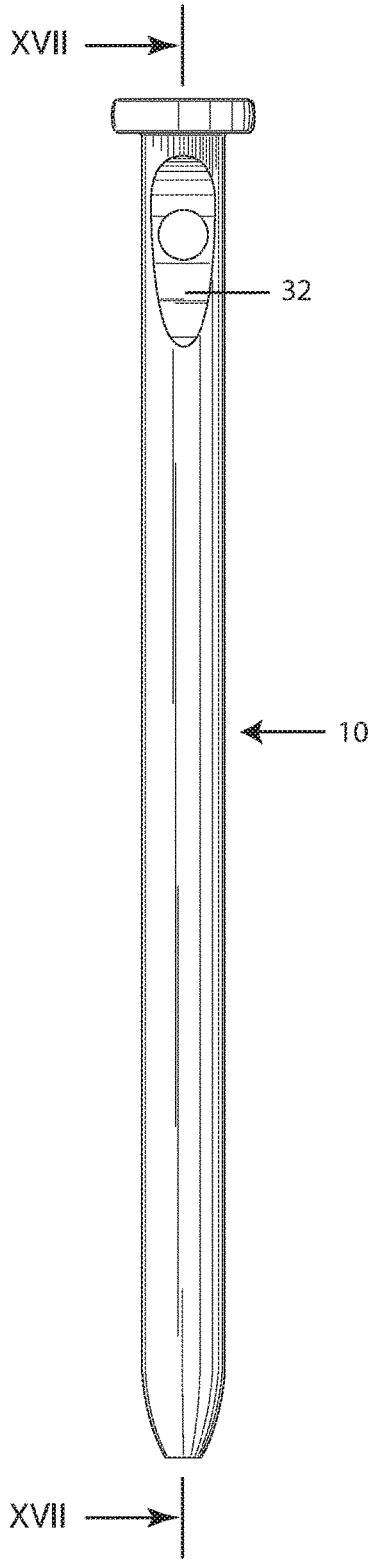
Figure 12:
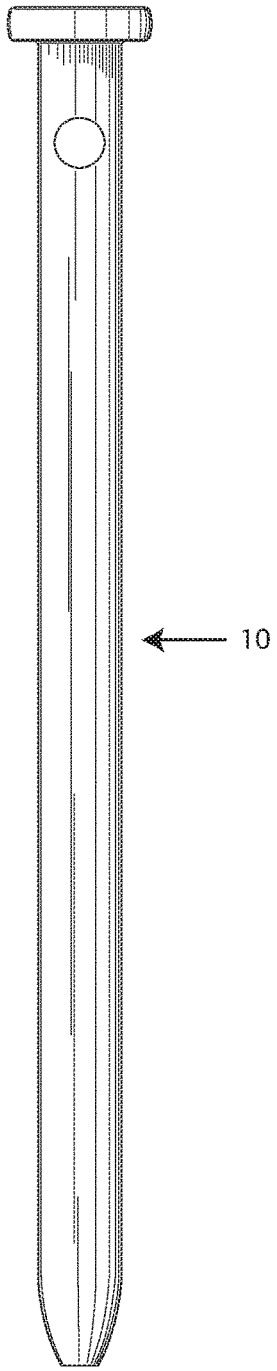
Figure 13:
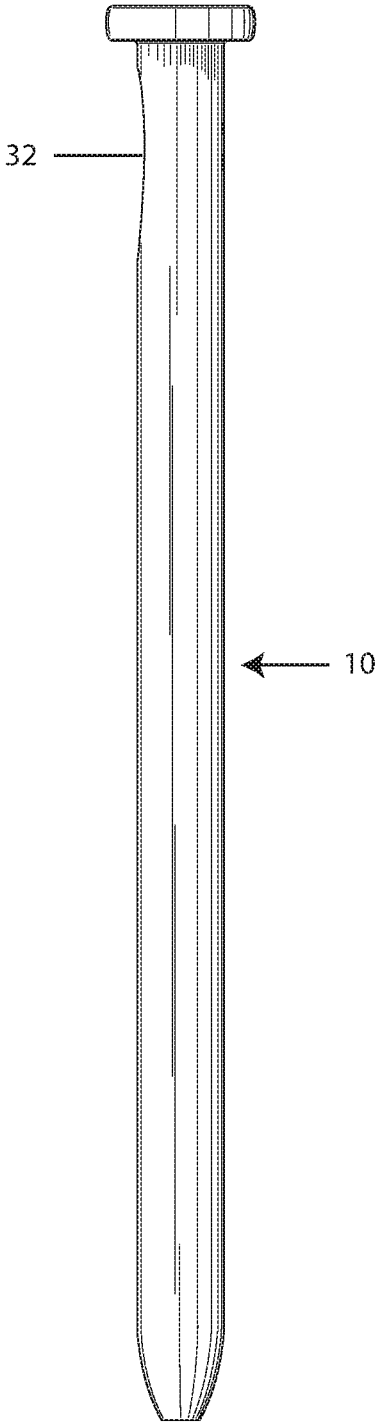
Figure 14:
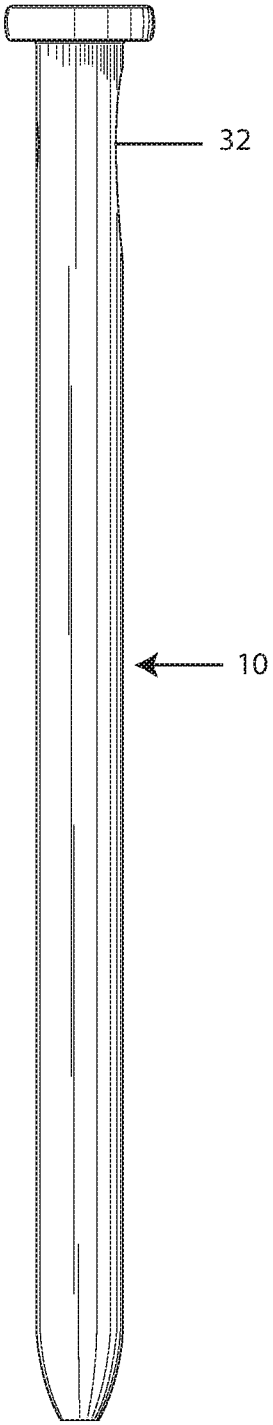
Figure 15:
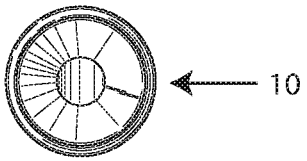
Figure 16:
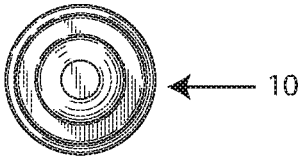
Figure 17:
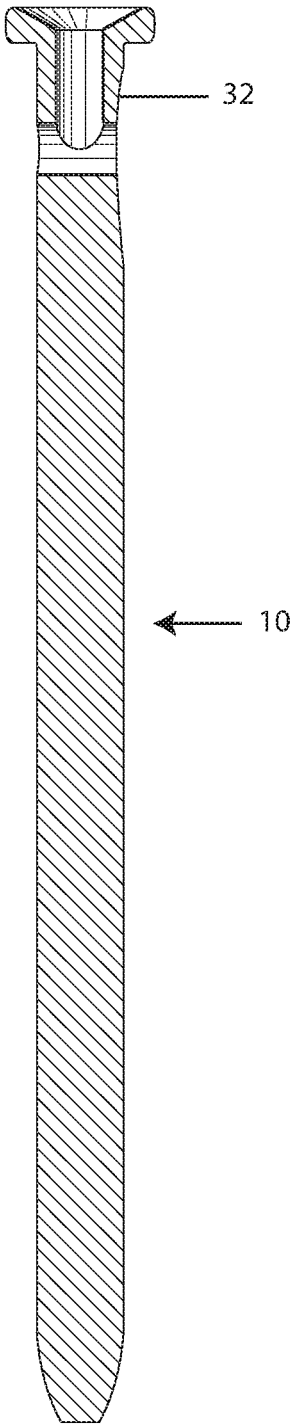
Figure 18:
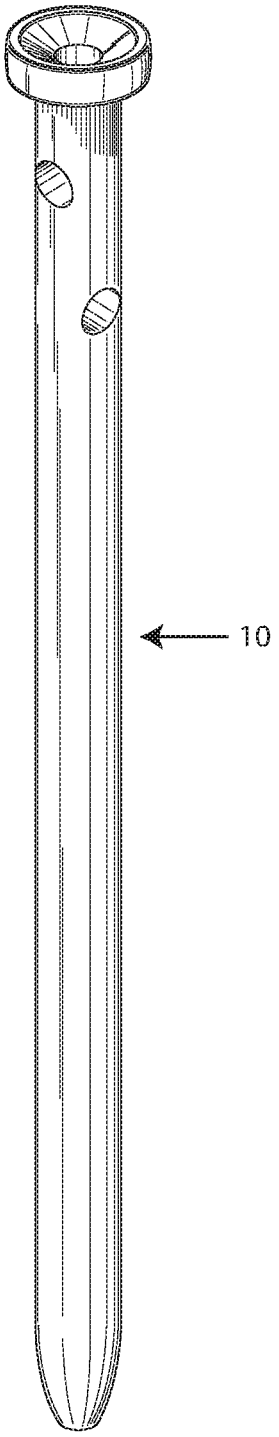
Figure 19:
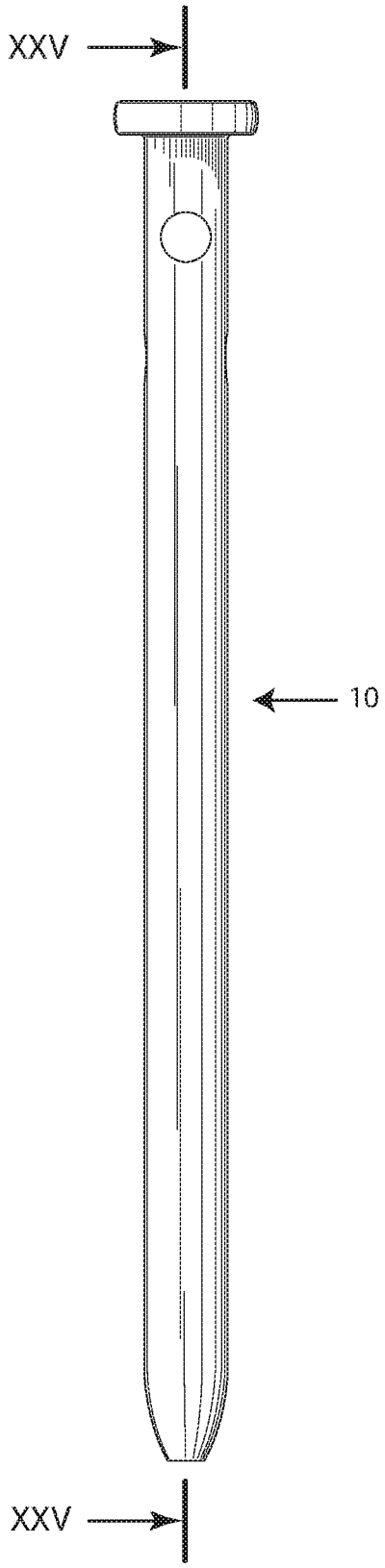
Figure 20:
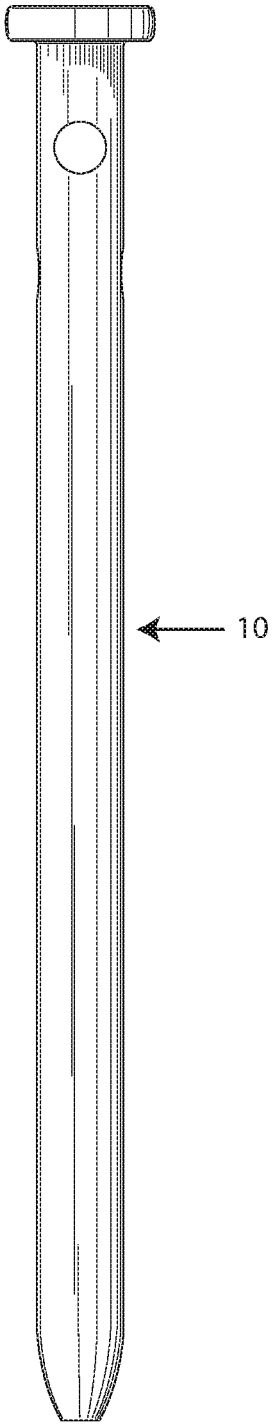
Figure 21:
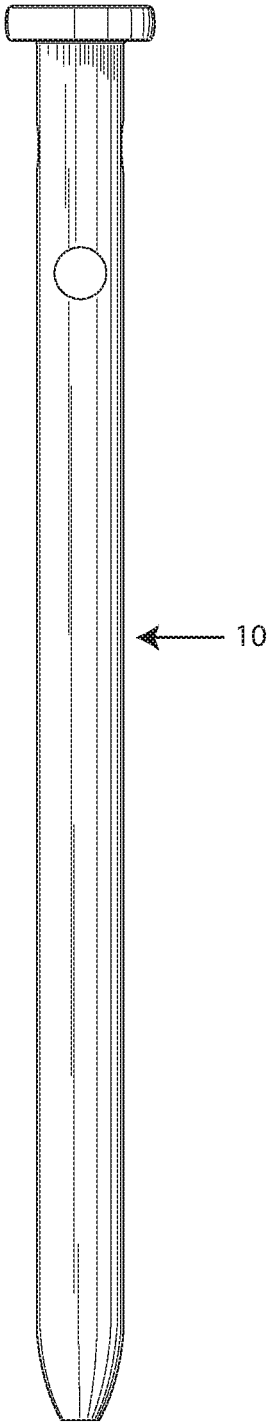
Figure 22:
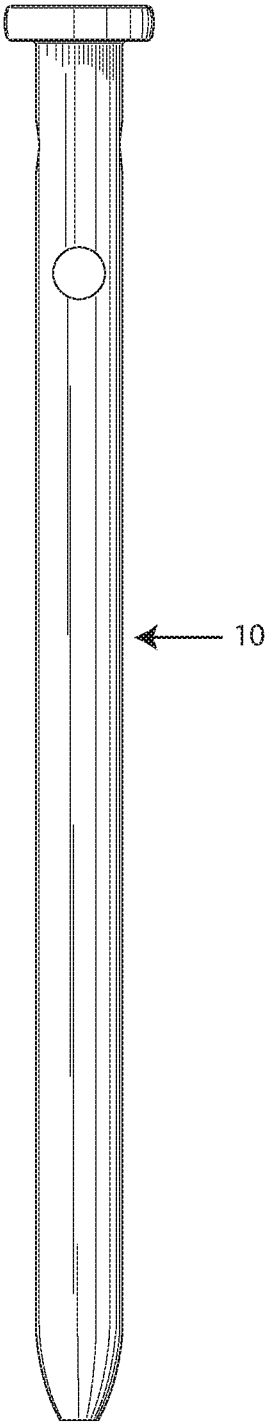
Figure 23:
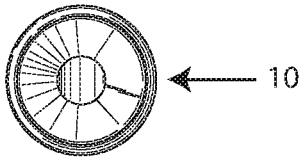
Figure 24:
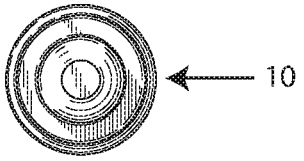
Figure 25:
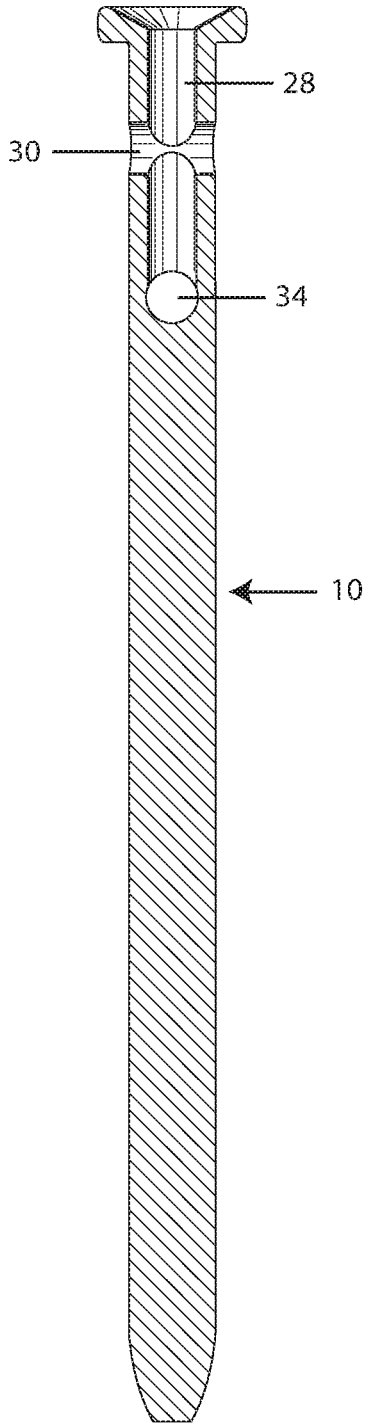
Figure 26:
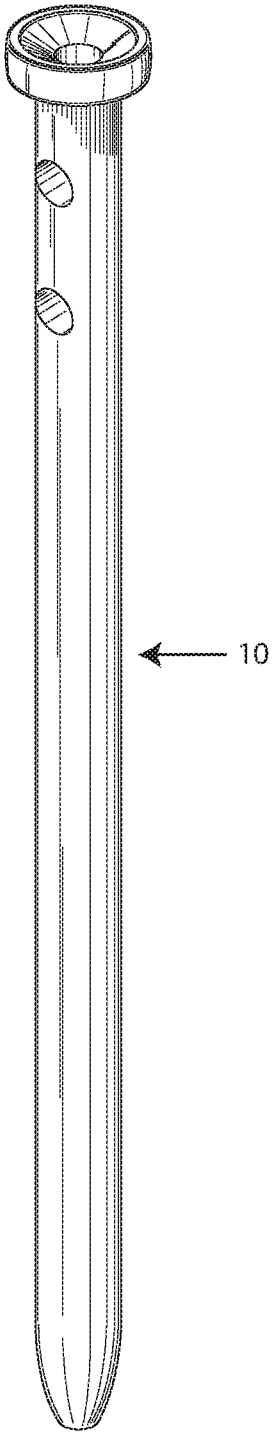
Figure 27:
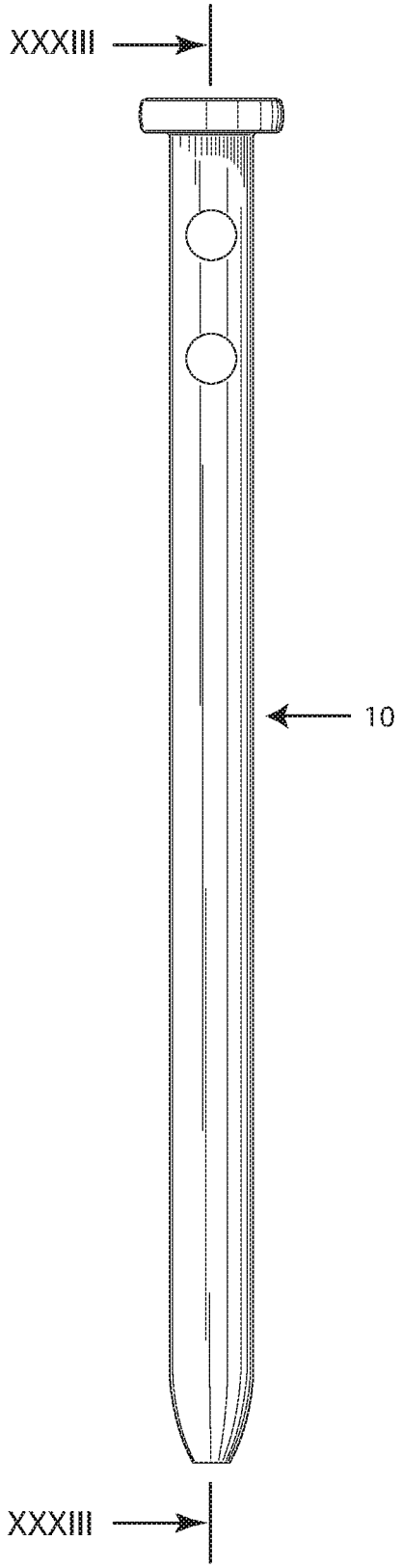
Figure 28:
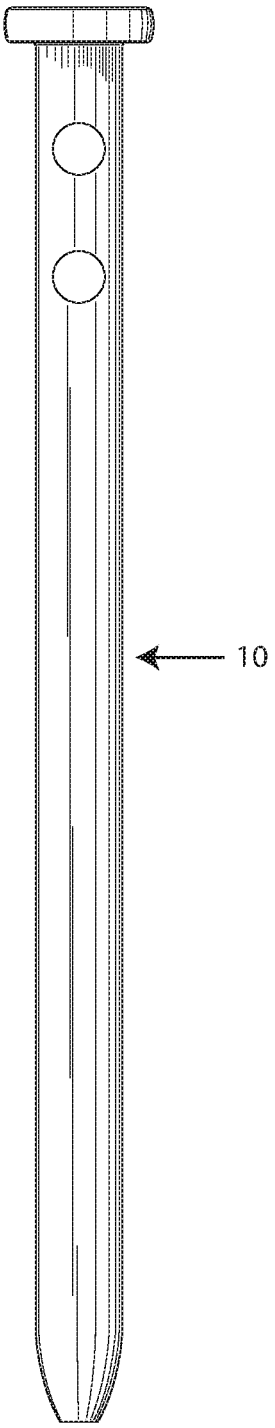
Figure 29:
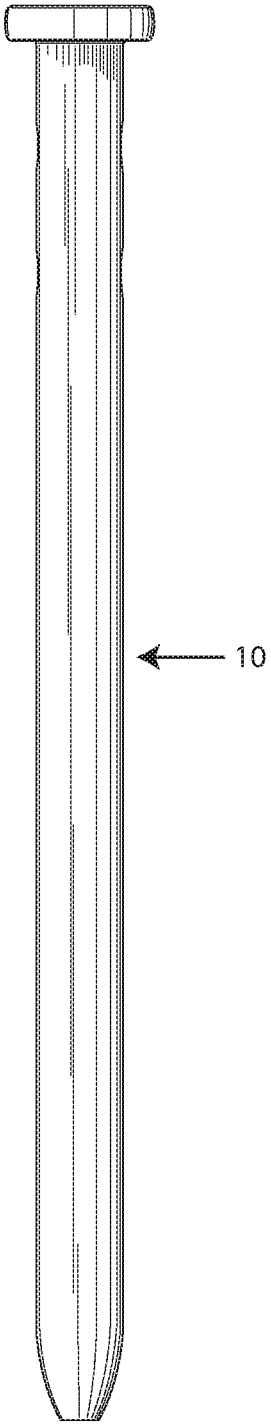
Figure 30:
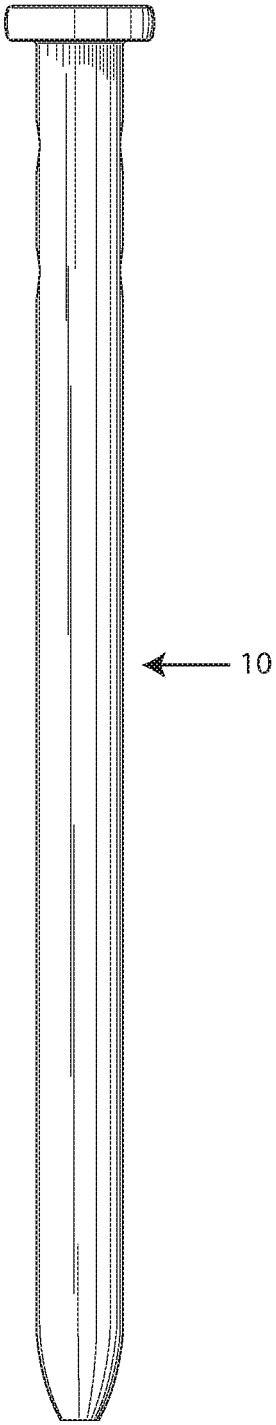
Figure 31:
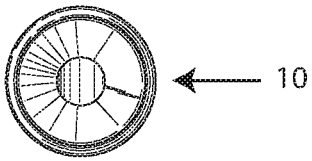
Figure 32:
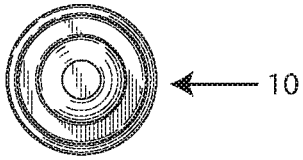
Figure 33:
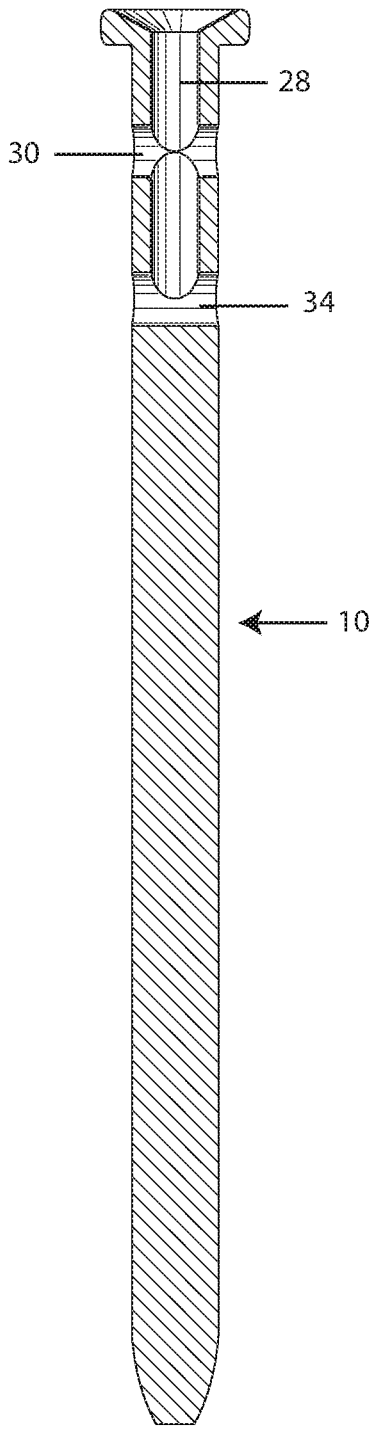

The invention will now be described with reference to the drawings wherein:

FIG. 1 of the drawings is a perspective view of a hinge pin in accordance with the present invention;

FIG. 2 of the drawings is a front view of the hinge pin of FIG. 1;

FIG. 3 of the drawings is a rear view of the hinge pin of FIG. 1;

FIG. 4 of the drawings is a left side view of the hinge pin of FIG. 1;

FIG. 5 of the drawings is a right side view of the hinge pin of FIG. 1;

FIG. 6 of the drawings is a top view of the hinge pin of FIG. 1;

FIG. 7 of the drawings is a bottom view of the hinge pin of FIG. 1;

FIG. 8 of the drawings is a cross-sectional view of the hinge pin taken along line VIII of FIG. 2;

FIG. 9 of the drawings is a perspective view of a hinge pin assembly utilizing the hinge pin of FIG. 1;

FIG. 10 of the drawings is a perspective view of an alternative embodiment of a hinge pin in accordance with the present invention;

FIG. 11 of the drawings is a front view of the hinge pin of FIG. 10;

FIG. 12 of the drawings is a rear view of the hinge pin of FIG. 10;

FIG. 13 of the drawings is a left side view of the hinge pin of FIG. 10;

FIG. 14 of the drawings is a right side view of the hinge pin of FIG. 10;

FIG. 15 of the drawings is a top view of the hinge pin of FIG. 10;

FIG. 16 of the drawings is a bottom view of the hinge pin of FIG. 10;

FIG. 17 of the drawings is a cross-sectional view of the hinge pin taken along line XVII of FIG. 10;

FIG. 18 of the drawings is a perspective view of an alternative embodiment of a hinge pin in accordance with the present invention;

FIG. 19 of the drawings is a front view of the hinge pin of FIG. 18;

FIG. 20 of the drawings is a rear view of the hinge pin of FIG. 18;

FIG. 21 of the drawings is a left side view of the hinge pin of FIG. 18;

FIG. 22 of the drawings is a right side view of the hinge pin of FIG. 18;

FIG. 23 of the drawings is a top view of the hinge pin of FIG. 18;

FIG. 24 of the drawings is a bottom view of the hinge pin of FIG. 18;

FIG. 25 of the drawings is a cross-sectional view of the hinge pin taken along line XXV of FIG. 18;

FIG. 26 of the drawings is a perspective view of an alternative embodiment of a hinge pin in accordance with the present invention;

FIG. 27 of the drawings is a front view of the hinge pin of FIG. 26;

FIG. 28 of the drawings is a rear view of the hinge pin of FIG. 26;

FIG. 29 of the drawings is a left side view of the hinge pin of FIG. 26;

FIG. 30 of the drawings is a right side view of the hinge pin of FIG. 26;

FIG. 31 of the drawings is a top view of the hinge pin of FIG. 26;

FIG. 32 of the drawings is a bottom view of the hinge pin of FIG. 26; and FIG. 33 of the drawings is a cross-sectional view of the hinge pin taken along line XXXIII of FIG. 26.

DETAILED DESCRIPTION OF THE INVENTION

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

Referring now to the drawings, and to FIGS. 1-8 in particular, hinge pin 10, for use in association with a hinge assembly, is shown as generally comprising head 12, body 14, and tip 16. In accordance with the present invention, hinge pin 10 allows a user to quickly, cleanly, and conveniently lubricate an associated door hinge (See FIG. 9) without, for example, overspray onto doors, doorjambs, walls, and/or the door hinge assembly itself—when using conventional lubricant sprayed from a can.

Head 12 includes fluid reservoir 18 for containing/retaining a lubricant (e.g., a petroleum-based lubricant, a silicone-based lubricant, etcetera) and fluid input aperture 20. Head 12 preferably includes a generally annular sidewall.

Body 14 includes first end 22, second end 24. The length of body 14, and, in turn, hinge pin 10 is defined between the first and second ends. Body 14 also includes one or more fluid output apertures 26 for dispensing lubricant. Primary bore/pathway 28 and secondary bore/pathway 30 are positioned between fluid input aperture 20 and one or more fluid output apertures 26, and cooperatively define a pathway for fluid flow (e.g., lubricant) therebetween. Body 14 preferably includes a generally annular sidewall.

Preferably primary bore 28 is positioned generally parallel (i.e., +/−15 degrees) and/or parallel to the length of body 14, and secondary bore 30 is preferably positioned generally perpendicular (i.e., +/−15 degrees) and/or perpendicular to the length of body 14.

Hinge pin 10 is preferably fabricated from a metal, a metal alloy, a natural resin, a synthetic resin, a plastic, a composite, wood, and/or combinations thereof.

Referring now to FIG. 9, door hinge assembly 100 comprises first hinge plate 102 having knuckles 104, second hinge plate 106 having knuckles 108, and hinge pin 10 (e.g., hinge pin 10 from FIGS. 1-8).

Referring now to FIGS. 10-17, in one embodiment of the present invention, body 14 of hinge pin 10 includes concave sidewall portion 32 proximate the fluid output aperture. The concave sidewall region serves as a secondary reservoir and enhances broader displacement of lubricant throughout the door hinge assembly.

Referring now to FIGS. 18-25, in one embodiment of the present invention, hinge pin 10 includes tertiary bore/pathway 34 positioned below primary and secondary bores/pathways 28 and 30, respectively. In this embodiment, hinge pin 10 comprises four output apertures 26 that are staggered 90 degrees from each other.

Referring now to FIGS. 26-33, in one embodiment of the present invention, hinge pin 10 includes tertiary bore/pathway 34 positioned below primary and secondary bores/pathways 28 and 30, respectively. In this embodiment, hinge pin 10 comprises two pair (four) output apertures 26 that are staggered 180 degrees from each other.

The foregoing description merely explains and illustrates the invention and the invention is not limited thereto except insofar as the appended claims are so limited, as those skilled in the art who have the disclosure before them will be able to make modifications without departing from the scope of the invention.

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etcetera shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can of course vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etcetera. As a non-limiting example, each range discussed herein can be readily broken down into a lower third, middle third and upper third, etcetera. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims.

What is claimed and desired to be secured by Letters Patent of the United States is:

1. A hinge pin that allows for clean and convenient internal lubrication of associated door hinge assemblies, comprising:

a head, a body, and a tip;

wherein the head includes a fluid reservoir, and a fluid input aperture;

wherein the body includes a first end, a second end, wherein the first end and the second end define a length therebetween, a first fluid output aperture, a primary bore, and a secondary bore;

wherein the primary and secondary bores are positioned between the fluid input aperture and the first fluid output aperture, and define a pathway for fluid flow therebetween;

wherein the body includes a generally annular sidewall; and wherein a portion of the generally annular sidewall of the body comprises a concave recess surrounding the first fluid output aperture, the concave recess is oval-shaped and has a first end proximate the head and a second end extending in a direction of the tip, and the first end of the concave recess is wider than the second end of the concave recess.

2. The hinge pin according to claim 1, wherein the head includes a generally annular sidewall.

3. The hinge pin according to claim 1, wherein the primary bore is positioned parallel to the length of the body.

4. The hinge pin according to claim 1, wherein the secondary bore is positioned perpendicular to the length of the body.

5. The hinge pin according to claim 1, further comprising a second fluid output aperture.

6. The hinge pin according to claim 5, wherein the first fluid output aperture and the second fluid output aperture are evenly spaced apart from each other.

7. The hinge pin according to claim 1, wherein the hinge pin is fabricated from a metal, a metal alloy, a natural resin, a synthetic resin, a plastic, a composite, wood, or combinations thereof.

8. A door hinge assembly, comprising:

a first hinge plate, wherein the first hinge plate includes at least one first knuckle;

a second hinge plate, wherein the second hinge plate includes at least one second knuckle; and a hinge pin that allows for clean and convenient internal lubrication of the at least one first knuckle and the at least one second knuckle, the hinge pin comprising:

a head, a body, and a tip;

wherein the head includes a fluid reservoir, and a fluid input aperture;

wherein the body includes a first end, a second end, wherein the first end and the second end define a length therebetween, a first fluid output aperture, a primary bore, and a secondary bore;

wherein the primary and secondary bores are positioned between the fluid input aperture and the first fluid output aperture, and define a pathway for fluid flow therebetween;

wherein the body includes a generally annular sidewall; and wherein a portion of the generally annular sidewall of the body comprises a concave recess surrounding the first fluid output aperture, the concave recess is oval-shaped and has a first end proximate the head and a second end extending in a direction of the tip, and the first end of the concave recess is wider than the second end of the concave recess.

9. The door hinge assembly according to claim 8, wherein the head includes a generally annular sidewall.

10. The door hinge assembly according to claim 8, wherein the primary bore is positioned parallel to the length of the body.

11. The door hinge assembly according to claim 8, wherein the secondary bore is positioned perpendicular to the length of the body.

12. The door hinge assembly according to claim 8, further comprising a second fluid output aperture.

13. The door hinge assembly according to claim 12, wherein the first fluid output aperture and the second fluid output aperture are evenly spaced apart from each other.

14. The door hinge assembly according to claim 8, wherein the hinge pin is fabricated from a metal, a metal alloy, a natural resin, a synthetic resin, a plastic, a composite, wood, or combinations thereof.

* * * * *